US006984420B2

(12) United States Patent
Suzuki et al.

(10) Patent No.: US 6,984,420 B2
(45) Date of Patent: Jan. 10, 2006

(54) METHOD FOR COLOR MATCHING USING POWDER COATINGS

(75) Inventors: Shoichi Suzuki, Mobara (JP); Yukiya Sato, Wakayama (JP); Kazuhiko Nakayama, Wakayama (JP)

(73) Assignee: Nippon Paint Co., Ltd., Osaka (JP)

( * ) Notice: Subject to any disclaimer, the term of this patent is extended or adjusted under 35 U.S.C. 154(b) by 174 days.

(21) Appl. No.: 10/367,941

(22) Filed: Feb. 19, 2003

(65) Prior Publication Data

US 2004/0162641 A1 Aug. 19, 2004

(51) Int. Cl.
*B05D 1/12* (2006.01)

(52) U.S. Cl. ..... 427/475; 427/195; 427/201

(58) Field of Classification Search ..... 427/475, 427/478, 195, 345, 201–203; 118/312
See application file for complete search history.

(56) References Cited

U.S. PATENT DOCUMENTS 4,373,820 A * 2/1983 Browning ..... 366/101
5,319,001 A * 6/1994 Morgan et al. ..... 523/205

FOREIGN PATENT DOCUMENTS

JP 10-212435 8/1998
JP 2899966 B2 3/1999
JP 11-293160 10/1999
JP 2002053810 * 2/2002
WO WO90/06345 6/1990
WO WO95/19399 7/1995

* cited by examiner

*Primary Examiner*—Fred J. Parker
(74) *Attorney, Agent, or Firm*—Birch, Stewart, Kolasch & Birch, LLP

(57) ABSTRACT

A method for color matching using a combination of two or more powder coatings having different colors from each other to give a target color, wherein lightness, blending weight ratio and volume-average particle size of the powder coatings to be combined satisfy the following formula (I):

$$\sum_{i=1}^{N} |L_0 - L_i| \times W_i \times D_i \leqq 190 \quad \text{(I)}$$

and a method for preparing a coating film comprising applying powder coatings combined by the above method to a substrate. According to this method, since a coating film having homogeneous color with low mottling is obtained from two or more powder coatings having different colors from each other, the method can be used as a simplified process for color matching using the powder coatings requiring only a few primary color powder coatings to be furnished.

5 Claims, 1 Drawing Sheet

METHOD FOR COLOR MATCHING USING POWDER COATINGS

BACKGROUND OF THE INVENTION

1. Field of the Invention

The present invention relates to a method for color matching using a combination of two or more powder coatings having different colors from each other to give a target color, and a method for producing a coating film.

2. Discussion of the Related Art

A powder coating is prepared by adding several colors of colorants to a resin, a curing agent, an additive, and the like, mixing the components, kneading the resulting mixture in a molten state, and subsequently cooling and pulverizing the mixture, and optionally classifying the particles by size. Generally, when two or more powder coatings having different colors from each other thus prepared are applied in a mixture, the coating film obtained appears macroscopically to be uneven (this appearance is hereinafter referred to as "mottling"). For this reason, a coating need to be supplied for each color needed so that a vast number of kinds of coatings have to be furnished.

In order to solve this problem, for the sake of simplifying the method for color matching using powder coating, there has been desired the development of a method for color matching to a broad range of colors by combining several colored powders.

Japanese Unexamined Patent Publication No. Hei 4-504431 proposes a method capable of applying a powder having a particle size of which color differences are visually indistinguishable, i.e., a maximum particle size of 10 $\mu$m or less, comprising granulating the powder so that particles having different colors are not segregated, and applying the granules using an ordinary electrostatic coating machine. However, the production steps are complicated because the powder coating is pulverized to a particle size of 10 $\mu$m or less, and granulated.

Japanese Patent Laid-Open No. Hei 11-293160 proposes a method comprising carrying out dry-blend color matching using plural colored translucent powder coatings containing a coloring agent and a clear translucent powder coating not containing a coloring agent. However, these translucent coatings are susceptible to affect the color of the substrate to be coated.

European Patent Publication No. 724611 proposes a method of special coating comprising mixing several colored thermosetting powder coatings containing a "bleeding" dye or pigment. However, since the dye or pigment used is likely to "bleed," the coating film obtained is likely to be faded by the solvents, and the "two-coat two-bake" treatment is required, thereby making the coating process complicated.

Also, Japanese Patent No. 2899966 proposes a method using a powder coating that does not thermally cure alone at temperatures of 250° C. or less but is thermally cured at temperatures of 250° C. or less when mixed with another kind of powder coating, and applied. Although an effect can be obtained to a certain extent, further improvements have been desired.

An object of the present invention is to provide a method for color matching using a combination of two or more powder coatings having different colors, thereby giving a coating film having homogeneous color with low mottling as a simplified process for color matching using the powder coatings, and a method for producing a coating film.

These and other objects of the present invention will be apparent from the following description.

SUMMARY OF THE INVENTION

In view of the aforementioned prior art technology, the present inventors have studied the relationship between color mottling in coating films and unevenness in the lightness (L* value), unevenness in the chroma (C* value), and unevenness in the hue angle (h value) as determined in accordance with the L*C*h calorimetric system. As a result, the present inventors have found that mottling on a coating film largely depends on unevenness in the lightness, as shown in FIG. 1. The present inventors have made further studies based on this finding for a factor that determines the magnitude of unevenness in the lightness. The present invention has been accomplished thereby.

According to the present invention, there are provided a method for color matching using a combination of two or more powder coatings having different colors from each other to give a target color, wherein lightness, blending weight ratio and volume-average particle size of the powder coatings to be combined satisfy the formula (I):

$$\sum_{i=1}^{N} |L_0 - L_i| \times W_i \times D_i \leqq 190 \quad \text{(I)}$$

wherein N is a number of powder coatings to be combined, which is an integer of 2 or more, $L_0$ is lightness of a target color, $L_i$ is lightness of an "i"th powder coating to be combined, $W_i$ is a blending weight ratio of an "i"th powder coating to be combined ($0<W_i<1$), and $D_i$ is a volume-average particle size ($\mu$m) of an "i"th powder coating to be combined; and a method for preparing a coating film comprising applying powder coatings combined by the method for color matching using powder coatings to a substrate.

DETAILED DESCRIPTION OF THE INVENTION

Figure 1:
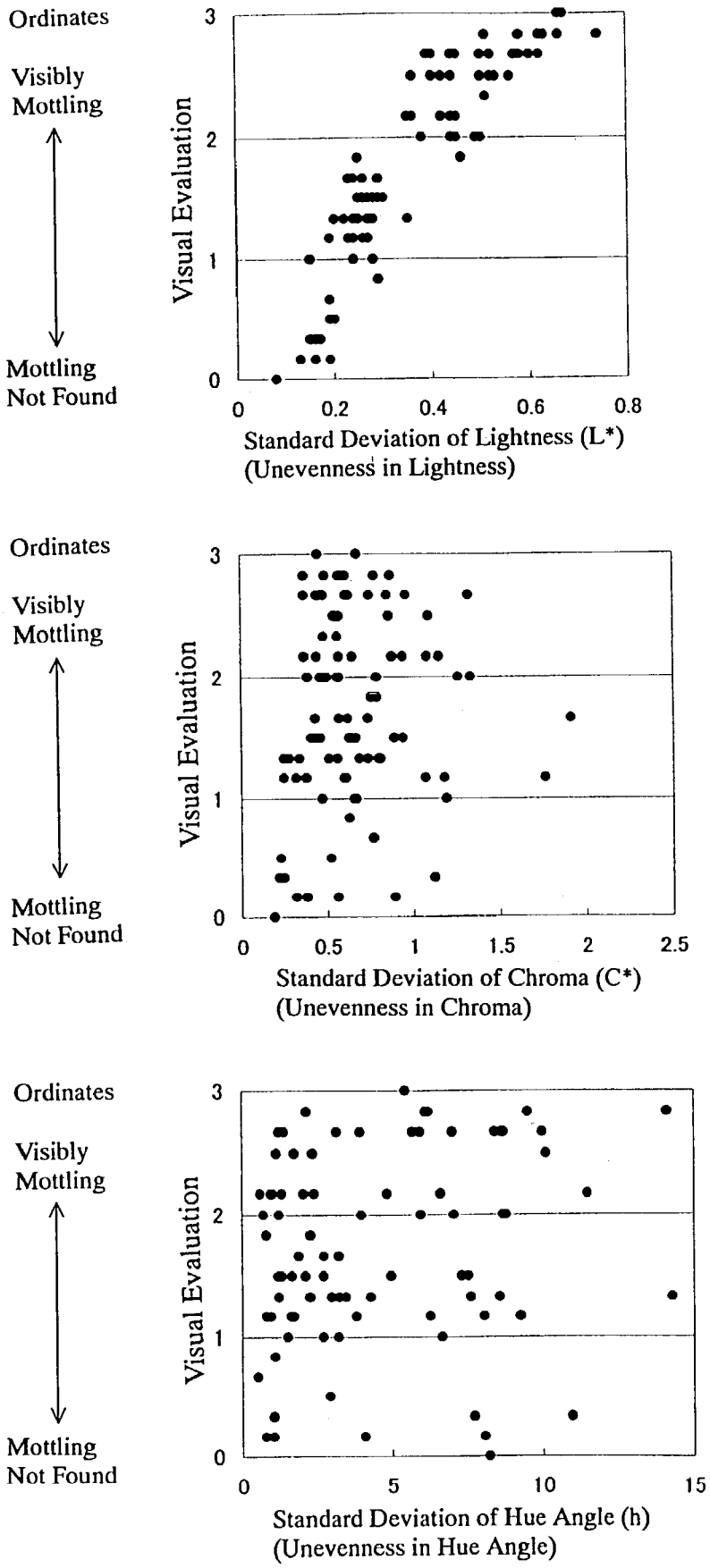
FIG. 1 is a graph showing the relationship between mottling in coating films and unevenness in the lightness (L* value), unevenness in the chroma (C* value), and unevenness in the hue angle (h value), wherein the abscissa shows standard deviation of distribution of each color factor, by taking color determination at all parts of 160000 locations obtained by dividing a region within 40 mm×40 mm into each region of 0.1 mm×0.1 mm.

In the present invention, the color matching is carried out by combining two or more powder coatings having different colors from each other, wherein lightness, blending weight ratio and volume-average particle size of the powder coatings to be combined satisfy the formula (I):

$$\sum_{i=1}^{N} |L_0 - L_i| \times W_i \times D_i \leqq 190 \quad \text{(I)}$$

wherein N is a number of powder coatings to be combined, which is an integer of 2 or more, $L_0$ is lightness of a target color, $L_i$ is lightness of an "i"th powder coating to be combined, $W_i$ is a blending weight ratio of an "i"th powder coating to be combined ($0<W_i<1$), $D_i$ is a volume-average particle size ($\mu$m) of an "i"th powder coating to be combined, to give a target color. The "target color" in the present invention refers to the color of a coating film to be obtained by applying and stoving two or more powder coatings at a specified mixing ratio, $L_0$ and $L_i$ are measured using the same light source. "Color" means a combination of the three properties of hue, lightness and chroma.

By color matching using a combination of powder coatings so that the lightness, the blending weight ratio, and the volume-average particle size satisfy the particular relationship shown by formula (I), a homogeneously colored coating film with little mottling is obtained even when two or more powder coatings having different colors from each other are combined. Hence, when the powder coatings having different colors from each other are combined to give a desired color (target color), in addition to the blending weight ratio and the volume-average particle size of the powder coatings to be combined, the difference in lightness between each powder coating to be combined and the target color seriously affects the color mottling of the coating film. Therefore, the smaller the total sum of each product for the three characteristic values is, a coating film having less mottling and higher homogeneous color is obtained. When the total sum of each product for the three characteristic values is 190 or less, preferably 130 or less, the coating film obtained has a still more homogeneous color with little mottling. By utilizing the formula (I), it is evident that even when powder coatings showing a great difference in lightness from the target color are combined, the color matching can be carried out to give a target color with little mottling and higher homogeneity by using the powder coatings at lowered blending weight ratios and smaller volume-average particle size.

Furthermore, in the present invention, coating films having a broad range of colors can be obtained from a few primary color powder coatings by color matching based on the formula (I), thereby making it possible to reduce the number of powder coatings. In other words, the color matching can be achieved to give a target color mainly with adjusting hue by a combination of powder coatings having highly chromatic colors and adjusting lightness by a combination of powder coatings having achromatic colors. Therefore, color matching to a broad range of colors, including intermediate colors, can be carried out by furnishing both a powder coating having achromatic color with easy adjustment of lightness and a plurality of powder coatings having highly chromatic colors with lightness not greatly differing among the coatings. Therefore, in the present invention, it is preferable that the color matching can be carried out by combining one or more powder coatings having achromatic colors and one or more powder coatings having chromatic colors, from the viewpoint of a reduction in the number of powder coatings furnished. It is preferable that one or two powder coatings having achromatic colors are used, wherein the difference in lightness between the powder coatings having achromatic colors used for color matching expressed as L* value, is preferably 25 or less, more preferably 20 or less, and, from the viewpoint of the number of powder coatings furnished, 5 or more. Also, the difference in lightness between the chromatic colors used for color matching is preferably 30 or less, more preferably 25 or less. In the present invention, a powder coating having an achromatic color refers to a powder coating in which both the a* value and the b* value are greater than −5 and less than +5, and a powder coating having a chromatic color refers to a powder coating in which at least one of the a* value and the b* value is −5 or less or +5 or more.

The lightness in the formula (I) refers to an L* value determined using the L*a*b* calorimetric system (CIE1976), standardized by Commission Internationale de l'Eclairage (CIE) and adopted in JIS Z 8729, and the above-mentioned a* and b* values indicate chromaticity in the same calorimetric system. The L*, a* and b* values are determined by the SCI system (a calorimetric system including the direction of regular reflection), which is a colorimetric method of which found values do not depend on the surface conditions of the object.

In the blending weight ratio in the formula (I), the value of [weight of the "i"th powder coating to be combined/total weight of powder coatings used for color matching] ($0<W_i<1$) is used.

In the present invention, when the powder coatings are combined, two or more powder coatings are selected so that the formula (I) is satisfied, and the selection is appropriately made in consideration of the lightness, the blending weight ratio and the volume-average particle size of the powder coatings. A judgment on whether or not the formula (I) is satisfied can be made empirically for analogous combinations, once a judgment is made on a specified combination.

As the powder coating usable in the present invention, those powder coatings which are conventionally used, comprising a resin and a coloring agent, preferably further containing a curing agent, can be used without particular limitation. It is desired that at least one powder coating to be combined, preferably 80% by weight or more of the powder coatings used, and more preferably all powder coatings, is opaque in order to reduce the influence of the color of the substrate to be coated.

In the present invention, an opaque powder coating refers to a powder coating having characteristics such that the color of the coating film obtained by applying and stoving the powder coatings is not affected by the color of the substrate to be coated (base), i.e., a powder coating capable of giving sufficient covering ability for the coating film. Concretely, a powder coating containing an inorganic pigment described below can be used.

As the resin, those resin which are conventionally known can be used without particular limitation. The resins include, for instance, non-reactive resins such as polyethylene, nylon resin and vinyl chloride, and reactive resins such as epoxy resin, polyester resin and acrylic resin. These resins may be used in admixture of two or more kinds. Among these resins, the polyester resin, the epoxy resin and the acrylic resin are preferred, and it is more preferable that the polyester resin and/or the epoxy resin are contained as a main ingredient in an amount of 50 to 100% by weight in the resin binder.

As the curing agents, those curing agents which are conventionally known can be used without particular limitation, as long as the curing agent is suitable for the functional groups of the reactive resin used. The curing agents include, for instance, polyisocyanate-based curing agents such as tolylene diisocyanate and xylylene diisocyanate; isocyanurate-based curing agents such as 1,3,5-triglycidyl isocyanurate; block isocyanate-based curing agents; epoxy-based curing agents such as bisphenol A diglycydyl ether; alkoxysilane-based curing agents; polyazilidine-based curing agents; oxazoline-based curing agents; and the like.

The content of curing agent, which varies depending on the content of functional groups in the resin, is preferably within the range of from 0.8 to 1.2 in terms of the equivalence ratio of the functional groups.

As the colorants, there can be used all inorganic pigments and organic pigments in common use in powder coatings. The inorganic pigments include titanium oxide, red iron oxide, chromium titanium yellow, yellow iron oxide, carbon black and the like. The organic pigments include azo-based, perylene-based, condensed azo-based, nitro-based, nitroso-based, phthalocyanine-based, anthraquinone-based, quinacridone-based, dioxane-based and other pigments. Specifically, the azo-based pigments include lake red, fast yellow, disazo yellow, permanent red and the like; the nitro-based pigments include naphthol yellow and the like; the nitroso-based pigments include pigment green B, naphthol green and the like; the phthalocyanine pigments include phthalocyanine blue, phthalocyanine green and the like; the anthraquinone-based pigments include indanthrene blue, dianthraquinolyl red and the like; the quinacridone-based pigments include quinacridone red, quinacridone violet and the like; and the dioxane-based pigments include carbazole dioxazine violet and the like. The content of the colorant varies depending on the kinds thereof. The content of the inorganic pigment is preferably from 1 to 60 parts by weight, and the content of the organic pigment is preferably from 0.05 to 30 parts by weight, each content based on 100 parts by weight of the resin.

The inorganic pigment is effective for giving covering ability to a coating film, so that an opaque powder coating is produced thereby, when the inorganic pigment is used alone or in admixture of two or more kinds. However, since the organic pigment per se has impaired effect of giving covering ability, the resulting powder coating becomes transparent when the organic pigment is used alone as a colorant. Therefore, when an organic pigment is used in the present invention, for which an opaque powder coating is preferably used, it is preferable to use the organic pigment together with the inorganic pigment. In particular, as the inorganic pigment to be used together with the organic pigment, titanium oxide is a preferred from the viewpoint of being capable of giving covering ability to a coating film without affecting the hue of the organic pigment.

The powder coating may optionally contain a leveling agent such as an acrylate polymer, a cross-linking accelerator such as various catalysts and organotin compounds, an agent for preventing pinholes such as benzoin, and other additives.

The powder coating usable in the present invention can, for example, be prepared by melt-kneading a resin, a curing agent, a colorant, an additive, and the like with an extruder or the like, cooling the extruded product, subsequently physical pulverizing the product using a mechanical mill, e.g., a hammer-mill or a jet-impact mill, and then classifying the particles using a classifier such as an air classifier or a micron classifier. There may also used a method comprising dispersing a resin, a curing agent, a colorant, and the like in a resin-soluble solvent, and subjecting to the resulting mixture to spray-drying, phase separation, and other processes; or a method comprising mixing a monomer constituting a resin with a curing agent, a coloring agent, and the like, and subjecting this mixture to suspension polymerization or emulsification polymerization. The obtained particles may be aggregated with each other to obtain a desired particle size. Further, the surface of the powder coating may be treated with a fluidity adjusting agent such as silica, alumina, titania or zirconia.

The volume-average particle size of the powder coating is preferably 15 μm or more, more preferably 17 μm or more, from the viewpoints of slidability, coating efficiency and storage property, and the volume-average particle size of the powder coating is preferably 50 μm or less, more preferably 30 μm or less, from the viewpoint of smoothness. Hence, the volume average particle size of the powder coating is preferably from 15 to 50 μm, more preferably exceeding 17 μm and 50 μm or less, and still more preferably exceeding 17 μm and 30 μm or less. In the present invention, it is desired that at least one powder coating of the powder coatings to be combined, preferably 80% by weight or more of the powder coatings used, and more preferably all powder coatings have a volume-average particle size as defined above.

In the present invention, when color matching of particular primary colors is carried out in order to obtain a coating film having the same color as a target color shown in an available color sample or the like, there can be selected the kinds of primary colors and the blending weight ratio of the respective primary colors which are required for color matching (toning) by using Computer Color Matching (CCM).

A coating film can be produced using powder coatings which are combined by the method for color matching of the present invention. Specifically, a coating film can be formed by, for example, applying and stoving two or more powder coatings combined according to the present invention. The coating film obtained by the color matching method of the present invention has a homogeneous color having the same level of lightness as the target color and little mottling.

In the present invention, it is preferable that two or more powder coatings are previously mixed and then applied. Alternatively, two or more powder coatings may be applied with continuously feeding the powder coatings to a coating machine, or using coating machines corresponding to each of powder coatings may be used. All the methods of blending powder coatings which are conventionally known can be used, including a method comprising dry-blending powder coatings with a high-speed mechanical mixer such as a Henschel mixer or Super mixer. The amount of each powder coating used is properly selected according to the color of the desired coating film.

The methods of applying powder coatings include, but are not particularly limited to, coating methods using an electrostatic spray, an electronic gun or the like, fluidized bed coating, plastic thermal spraying and the like, among which a coating method using an electrostatic spray of the corona discharge or frictional type is preferable.

The stoving of the powder coatings is not subject to particular limitation, as long as the stoving is carried out under such conditions that curing is sufficiently completed. Although the stoving temperature, time and the like cannot generally be determined because they vary depending on the kind of resin contained in the powder coating, the temperature for initiating curing of the mixture of the powder coatings combined, and the like, it is preferable that the stoving is carried out at 120° to 200° C. for about 10 to 30 minutes. Although the procedures for the application and stoving for powder coatings are not subject to particular limitation, it is preferable that these procedures are carried out on a "one-coat, one-bake" basis, from the viewpoint of working efficiency.

EXAMPLES

Examples 1 to 12 and Comparative Examples 1 to 7

Primary color powder coatings each having color properties (L* value, a* value and b* value) and a volume-average particle size as shown in Table 1 were toned into a target color having color properties shown in Table 2. Here, the volume-average particle size of the powder coating was measured by adding 0.08 of the powder coating to 20 ml of distilled water containing 0.4 g of sodium poly (n=4) oxyethylene alkyl (12 to 14 carbon atoms) ether sulfate, treating the mixture ultrasonically for two minutes, and determining the particle size with MICROTRACK HRA Particle Size Distribution Analyzer Model 9320-X100 (commercially available from Nikkiso Co., Ltd.).

[Preparation Examples of Primary Color Powder Coatings]

Fifty parts by weight of a polyester resin "CRYLCOAT CC-341" (commercially available from Daicel-UCB Co., Ltd.), 50 parts by weight of an epoxy resin "EPICOAT 1004AF" (commercially available from Yuka Shell Epoxy), a colorant in an amount used (parts by weight) shown in Table 1, 1 parts by weight of a leveling agent "DISPARON PL540" (commercially available from Kusumoto Chemicals, Ltd.), 1 part by weight of benzoin, an agent for preventing formation of pinholes, and 0.1 parts by weight of phenylimidazoline, a curing catalyst, were thoroughly mixed with Super Mixer (commercially available from Kawata MFG Co., Ltd.). The mixture was kneaded using Buss-coneader (commercially available from Buss), and the kneaded product was cooled. Thereafter, the product was pulverized with "Pulverizer ACM 10A" (commercially available from Hosokawa Micron Corporation) and the resulting powder was classified, to give a powder. One-hundred parts by weight of the resulting powder and 0.3 parts of a silica "R972" (commercially available from Nippon Aerozil Co., Ltd.) were homogeneously mixed with a Henschel mixer, to give a powder coating.

Each powder coating was electrostatically applied to a gray, zinc phosphate-treated steel plate, and stoved at 180° C. for 20 minutes, to give a coating film. The color properties of each powder coating were determined for each coating film obtained under the measurement conditions of F6 light source, 10° scope, SCI method using spectrocolorimeter "CM3600d" (commercially available from MINOLTA CO., LTD.). The color properties shown by all of these coating films had sufficient covering ability without being affected by gray undercoat. All of the measurement conditions of the found colorimetric values shown in Examples are the same as mentioned above.

TABLE 1

| Primary Color | | Color Properties | | | Volume-Average Particle Size (μm) | | |
|---|---|---|---|---|---|---|---|
| Powder Coating | Colorant/Amount Used* | L* | a* | b* | 18 | 24 | 48 |
| Achromatic Color 1 (White) | Titanium Oxide/45.0 | 95.60 | −0.80 | 0.73 | ○ | ○ | — |
| Achromatic Color 2 (Gray 1) | Titanium Oxide/44.865<br>Carbon Black/0.012 | 89.28 | −0.44 | 0.30 | — | ○ | — |
| Achromatic Color 3 (Gray 2) | Titanium Oxide/44.325<br>Carbon Black/0.06 | 80.06 | −0.39 | −0.87 | — | ○ | ○ |
| Achromatic Color 4 (Gray 3) | Titanium Oxide/42.75<br>Carbon Black/0.2 | 68.82 | −0.41 | −1.79 | — | ○ | ○ |
| Achromatic Color 5 (Gray 4) | Titanium Oxide/40.5<br>Carbon Black/0.4 | 60.95 | −0.45 | −2.41 | ○ | ○ | — |
| Chromatic Color 1 (Red) | Titanium Oxide/41.4<br>C.I. Pigment Violet 19/0.6 | 77.83 | 23.79 | −8.70 | ○ | ○ | ○ |
| Chromatic Color 2 (Ocher) | Titanium Oxide/20.0<br>C.I. Pigment Yellow 42/10.0 | 78.95 | 7.00 | 50.80 | — | ○ | ○ |
| Chromatic Color 3 (Purple) | Titanium Oxide/30.0<br>C.I. Pigment Violet 23/0.3 | 60.71 | 13.11 | −36.37 | ○ | ○ | — |
| Chromatic Color 4 (Rusty Red) | Titanium Oxide/30.0<br>C.I. Pigment Red 101/2.5 | 70.88 | 15.18 | 10.12 | ○ | ○ | ○ |
| Chromatic Color 5 (Yellow) | Titanium Oxide/6.0<br>C.I. Pigment Yellow 154/13.3 | 89.56 | −2.81 | 76.30 | — | ○ | ○ |
| Chromatic Color 6 (Green) | Titanium Oxide/30.0<br>C.I. Pigment Green 36/1.5 | 72.31 | −25.98 | 1.05 | — | ○ | — |
| Chromatic Color 7 (Blue) | Titanium Oxide/41.4<br>C.I. Pigment Blue 15:4/0.8 | 68.17 | −14.97 | −35.39 | — | ○ | — |

Note:
Amount used is expressed by parts by weight based on 100 parts by weight of the resin.

TABLE 2

| | L* | a* | b* | Color |
|---|---|---|---|---|
| Target Color 1 | 75.63 | 21.6 | 6.24 | Nude a |
| Target Color 2 | 73.53 | 5.22 | −5.57 | Purple a |
| Target Color 3 | 66.86 | −0.80 | −0.08 | Gray a |
| Target Color 4 | 81.33 | −19.68 | −2.53 | Green |
| Target Color 5 | 76.35 | 0.55 | 9.01 | Beige |
| Target Color 6 | 65.16 | 9.67 | −11.37 | Purple b |
| Target Color 7 | 64.13 | 5.03 | −4.94 | Purple c |
| Target Color 8 | 89.48 | 0.72 | 0.86 | Gray b |
| Target Color 9 | 88.97 | 0.94 | 5.62 | Nude b |
| Target Color 10 | 87.25 | 0.89 | 8.30 | Nude c |
| Target Color 11 | 73.69 | 15.83 | −17.24 | Purple d |

The kinds of primary colors and the blending weight ratio of each primary color to be required for obtaining a coating film having the same color as the target color from the primary color powder coatings of Table 1 were calculated using Computer Color Matching System. Each primary color powder coating was weighed in accordance with the calculated blending weight ratio, and the powder coatings were mixed to tone the color. Thereafter, the mixed powder coatings were electrostatically applied on a gray, zinc phosphate-treated steel plate, and thereafter stoved at 180° C. for 20 minutes, to each of the coating films shown in Tables 3 to 5.

The homogeneousness of the color of the resulting coating film was evaluated by the following evaluation criteria.

[Evaluation Criteria]

When an individual having 20/20 (1.0)-vision when viewed with both eyes observed a coating film 50 cm away from the coating film, the coating film is visibly:

○: homogeneous,

Δ: slightly mottling, or

X: mottling.

TABLE 3

| | Target Color | Combination of Primary Color Powder Coating | Lightness | Weight Proportion | Particle Size (μm) | Value of Formula (I) | Homogeneousness of Color |
|---|---|---|---|---|---|---|---|
| Ex. 1 | Target Color 1 | Achromatic Color 1 (White) | $L_1$ 95.60 | $W_1$ 0.001 | $D_1$ 24 | 68 | ○ |
| | $L_0$ = 75.63 | Achromatic Color 5 (Gray 4) | $L_2$ 60.95 | $W_2$ 0.025 | $D_2$ 24 | | |
| | | Chromatic Color 1 (Red) | $L_3$ 77.83 | $W_3$ 0.690 | $D_3$ 24 | | |
| | | Chromatic Color 2 (Ocher) | $L_4$ 78.95 | $W_4$ 0.284 | $D_4$ 24 | | |
| Ex. 2 | Target Color 2 | Achromatic Color 3 (Gray 2) | $L_1$ 80.06 | $W_1$ 0.103 | $D_1$ 24 | 126 | ○ |
| | $L_0$ = 73.53 | Achromatic Color 4 (Gray 3) | $L_2$ 68.82 | $W_2$ 0.651 | $D_2$ 24 | | |
| | | Chromatic Color 1 (Red) | $L_3$ 77.83 | $W_3$ 0.194 | $D_3$ 24 | | |
| | | Chromatic Color 3 (Purple) | $L_4$ 60.71 | $W_4$ 0.052 | $D_4$ 24 | | |
| Ex. 3 | Target Color 3 | Achromatic Color 4 (Gray 3) | $L_1$ 68.82 | $W_1$ 0.467 | $D_1$ 24 | 109 | ○ |
| | $L_0$ = 66.86 | Achromatic Color 5 (Gray 4) | $L_2$ 60.95 | $W_2$ 0.457 | $D_2$ 24 | | |
| | | Chromatic Color 4 (Rusty Red) | $L_3$ 70.88 | $W_3$ 0.043 | $D_3$ 24 | | |
| | | Chromatic Color 5 (Ocher) | $L_4$ 89.56 | $W_4$ 0.033 | $D_4$ 24 | | |
| Ex. 4 | Target Color 4 | Achromatic Color 2 (Gray 1) | $L_1$ 89.28 | $W_1$ 0.415 | $D_1$ 24 | 170 | Δ |
| | $L_0$ = 81.33 | Achromatic Color 3 (Gray 2) | $L_2$ 80.06 | $W_2$ 0.198 | $D_2$ 24 | | |
| | | Chromatic Color 6 (Green) | $L_3$ 72.31 | $W_3$ 0.377 | $D_3$ 24 | | |
| | | Chromatic Color 7 (Blue) | $L_4$ 68.17 | $W_4$ 0.010 | $D_4$ 24 | | |
| Ex. 5 | Target Color 5 | Achromatic Color 3 (Gray 2) | $L_1$ 80.06 | $W_1$ 0.221 | $D_1$ 24 | 156 | Δ |
| | $L_0$ = 76.35 | Achromatic Color 4 (Gray 3) | $L_2$ 68.82 | $W_2$ 0.387 | $D_2$ 24 | | |
| | | Chromatic Color 1 (Red) | $L_3$ 77.83 | $W_3$ 0.205 | $D_3$ 24 | | |
| | | Chromatic Color 5 (Yellow) | $L_4$ 89.56 | $W_4$ 0.187 | $D_4$ 24 | | |
| Ex. 6 | Target Color 6 | Achromatic Color 4 (Gray 3) | $L_1$ 68.82 | $W_1$ 0.073 | $D_1$ 24 | 148 | Δ |
| | $L_0$ = 65.16 | Achromatic Color 5 (Gray 4) | $L_2$ 60.95 | $W_2$ 0.380 | $D_2$ 24 | | |
| | | Chromatic Color 1 (Red) | $L_3$ 77.83 | $W_3$ 0.227 | $D_3$ 24 | | |
| | | Chromatic Color 3 (Purple) | $L_4$ 60.71 | $W_4$ 0.320 | $D_4$ 24 | | |
| Ex. 7 | Target Color 7 | Achromatic Color 1 (White) | $L_1$ 95.60 | $W_1$ 0.080 | $D_1$ 24 | 145 | Δ |
| | $L_0$ = 64.13 | Achromatic Color 5 (Gray 4) | $L_2$ 60.95 | $W_2$ 0.539 | $D_2$ 24 | | |
| | | Chromatic Color 4 (Rusty Red) | $L_3$ 70.88 | $W_3$ 0.150 | $D_3$ 24 | | |
| | | Chromatic Color 3 (Purple) | $L_4$ 60.71 | $W_4$ 0.231 | $D_4$ 24 | | |
| Ex. 8 | Target Color 8 | Achromatic Color 1 (White) | $L_1$ 95.60 | $W_1$ 0.883 | $D_1$ 24 | 187 | Δ |
| | $L_0$ = 89.48 | Achromatic Color 5 (Gray 4) | $L_2$ 60.95 | $W_2$ 0.049 | $D_2$ 24 | | |
| | | Chromatic Color 4 (Rusty Red) | $L_3$ 70.88 | $W_3$ 0.035 | $D_3$ 24 | | |
| | | Chromatic Color 2 (Ocher) | $L_4$ 78.95 | $W_4$ 0.033 | $D_4$ 24 | | |

TABLE 4

| | Target Color | Combination of Primary Color Powder Coating | Lightness | Weight Proportion | Particle Size (μm) | Value of Formula (I) | Homogeneousness of Color |
|---|---|---|---|---|---|---|---|
| Comp. Ex. 1 | Target Color 9 | Achromatic Color 1 (White) | $L_1$ 95.60 | $W_1$ 0.837 | $D_1$ 24 | 193 | X |
| | $L_0$ = 88.97 | Achromatic Color 5 (Gray 4) | $L_2$ 60.95 | $W_2$ 0.024 | $D_2$ 24 | | |
| | | Chromatic Color 2 (Ocher) | $L_3$ 78.95 | $W_3$ 0.115 | $D_3$ 24 | | |
| | | Chromatic Color 3 (Purple) | $L_4$ 60.71 | $W_4$ 0.024 | $D_4$ 24 | | |
| Comp. Ex. 2 | Target Color 10 | Achromatic Color 1 (White) | $L_1$ 95.60 | $W_1$ 0.796 | $D_1$ 24 | 218 | X |
| | $L_0$ = 87.25 | Achromatic Color 5 (Gray 4) | $L_2$ 60.95 | $W_2$ 0.032 | $D_2$ 24 | | |
| | | Chromatic Color 4 (Rusty Red) | $L_3$ 70.88 | $W_3$ 0.022 | $D_3$ 24 | | |
| | | Chromatic Color 2 (Ocher) | $L_4$ 78.95 | $W_4$ 0.150 | $D_4$ 24 | | |
| Comp. Ex. 3 | Target Color 11 | Achromatic Color 1 (White) | $L_1$ 95.60 | $W_1$ 0.348 | $D_1$ 24 | 331 | X |
| | $L_0$ = 73.69 | Achromatic Color 5 (Gray 4) | $L_2$ 60.95 | $W_2$ 0.037 | $D_2$ 24 | | |
| | | Chromatic Color 1 (Red) | $L_3$ 77.83 | $W_3$ 0.260 | $D_3$ 24 | | |
| | | Chromatic Color 3 (Purple) | $L_4$ 60.71 | $W_4$ 0.355 | $D_4$ 24 | | |
| Comp. Ex. 4* | Target Color 5 | Achromatic Color 1 (White) | $L_1$ 95.60 | $W_1$ 0.381 | $D_1$ 24 | 326 | X |
| | $L_0$ = 76.35 | Achromatic Color 5 (Gray 4) | $L_2$ 60.95 | $W_2$ 0.227 | $D_2$ 24 | | |
| | | Chromatic Color 1 (Red) | $L_3$ 77.83 | $W_3$ 0.205 | $D_3$ 24 | | |
| | | Chromatic Color 5 (Yellow) | $L_4$ 89.56 | $W_4$ 0.187 | $D_4$ 24 | | |

Note

*Comparative Example 4 was obtained by changing achromatic colors of the powder coatings used in Example 5.

TABLE 5

| | Target Color | Combination of Primary Color Powder Coating | Lightness | Weight Proportion | Particle Size (μm) | Value of Formula (I) | Homogeneousness of Color |
|---|---|---|---|---|---|---|---|
| Ex. 9*1 | Target Color 1 | Achromatic Color 1 (White) | $L_1$ 95.60 | $W_1$ 0.001 | $D_1$ 24 | 127 | ○ |
| | $L_0$ = 75.63 | Achromatic Color 5 (Gray 4) | $L_2$ 60.95 | $W_2$ 0.025 | $D_2$ 24 | | |
| | | Chromatic Color 1 (Red) | $L_3$ 77.83 | $W_3$ 0.690 | $D_3$ 48 | | |
| | | Chromatic Color 2 (Ocher) | $L_4$ 78.95 | $W_4$ 0.284 | $D_4$ 48 | | |
| Ex. 10*2 | Target Color 3 | Achromatic Color 4 (Gray 3) | $L_1$ 68.82 | $W_1$ 0.467 | $D_1$ 48 | 135 | Δ |
| | $L_0$ = 66.86 | Achromatic Color 5 (Gray 4) | $L_2$ 60.95 | $W_2$ 0.457 | $D_2$ 24 | | |
| | | Chromatic Color 4 (Rusty Red) | $L_3$ 70.88 | $W_3$ 0.043 | $D_3$ 48 | | |
| | | Chromatic Color 5 (Yellow) | $L_4$ 89.56 | $W_4$ 0.033 | $D_4$ 24 | | |
| Ex. 11*3 | Target Color 5 | Achromatic Color 3 (Gray 2) | $L_1$ 80.06 | $W_1$ 0.221 | $D_1$ 48 | 183 | Δ |
| | $L_0$ = 76.35 | Achromatic Color 4 (Gray 3) | $L_2$ 68.82 | $W_2$ 0.387 | $D_2$ 24 | | |
| | | Chromatic Color 1 (Red) | $L_3$ 77.83 | $W_3$ 0.205 | $D_3$ 48 | | |
| | | Chromatic Color 5 (Yellow) | $L_4$ 89.56 | $W_4$ 0.187 | $D_4$ 24 | | |
| Ex. 12*4 | Target Color 10 | Achromatic Color 1 (White) | $L_1$ 95.60 | $W_1$ 0.796 | $D_1$ 18 | 171 | Δ |
| | $L_0$ = 87.25 | Achromatic Color 5 (Gray 4) | $L_2$ 60.95 | $W_2$ 0.032 | $D_2$ 18 | | |
| | | Chromatic Color 4 (Rusty Red) | $L_3$ 70.88 | $W_3$ 0.022 | $D_3$ 18 | | |
| | | Chromatic Color 2 (Ocher) | $L_4$ 78.95 | $W_4$ 0.150 | $D_4$ 24 | | |
| Comp. Ex. 5*5 | Target Color 2 | Achromatic Color 3 (Gray 2) | $L_1$ 80.06 | $W_1$ 0.103 | $D_1$ 24 | 219 | X |
| | $L_0$ = 73.53 | Achromatic Color 4 (Gray 3) | $L_2$ 68.82 | $W_2$ 0.651 | $D_2$ 48 | | |
| | | Chromatic Color 1 (Red) | $L_3$ 77.83 | $W_3$ 0.194 | $D_3$ 48 | | |
| | | Chromatic Color 3 (Purple) | $L_4$ 60.71 | $W_4$ 0.052 | $D_4$ 24 | | |
| Comp. Ex. 6*6 | Target Color 5 | Achromatic Color 3 (Gray 2) | $L_1$ 80.06 | $W_1$ 0.221 | $D_1$ 24 | 285 | X |
| | $L_0$ = 76.35 | Achromatic Color 4 (Gray 3) | $L_2$ 68.82 | $W_2$ 0.387 | $D_2$ 48 | | |
| | | Chromatic Color 1 (Red) | $L_3$ 77.83 | $W_3$ 0.205 | $D_3$ 24 | | |
| | | Chromatic Color 5 (Yellow) | $L_4$ 89.56 | $W_4$ 0.187 | $D_4$ 48 | | |
| Comp. Ex. 7*7 | Target Color 11 | Achromatic Color 1 (White) | $L_1$ 95.60 | $W_1$ 0.348 | $D_1$ 18 | 248 | X |
| | $L_0$ = 73.69 | Achromatic Color 5 (Gray 4) | $L_2$ 60.95 | $W_2$ 0.037 | $D_2$ 18 | | |
| | | Chromatic Color 1 (Red) | $L_3$ 77.83 | $W_3$ 0.260 | $D_3$ 18 | | |
| | | Chromatic Color 3 (Purple) | $L_4$ 60.71 | $W_4$ 0.355 | $D_4$ 18 | | |

Note
*1Example 9 was obtained by changing particle sizes of two primary colors of the powder coatings used in Example 1.
*2Example 10 was obtained by changing particle sizes of two primary colors of the powder coatings used in Example 3.
*3Example 11 was obtained by changing particle sizes of two primary colors of the powder coatings used in Example 5.
*4Example 12 was obtained by changing particle sizes of three primary colors of the powder coatings used in Comparative Example 2.
*5Comparative Example 5 was obtained by changing particle sizes of two primary colors of the powder coatings used in Example 2.
*6Comparative Example 6 was obtained by changing particle sizes of two primary colors of the powder coatings used in Example 5.
*7Comparative Example 7 was obtained by changing particle sizes of four primary colors of the powder coatings used in Comparative Example 3.

It can be seen from the above results from Examples 1 to 12 that by toning powder coatings in combination so that the lightness property, the blending weight ratio and its volume-average particle size of the powder coating to be combined satisfy a particular relationship, a coating film having a homogeneous color with little mottling can be obtained even when two or more powder coatings having different colors from each other are used. On the other hand, it can be seen from Comparative Example 1 to 7 that if the conditions set forth by the present invention are not satisfied, mottling is generated even when the powder coatings selected by Computer Color Matching System were combined.

According to the present invention, even when two or more powder coatings having different colors from each other are combined for toning the color and are applied, a coating film having homogeneous color with little mottling can be easily obtained.

What is claimed is:

1. A method for color matching which comprises selecting two or more powder coatings having different colors from each other to provide a combination of powder coatings for a target color, wherein lightness, blending weight ratio and volume-average particle size of the powder coatings to be combined satisfy the formula (I):

$$\sum_{i=1}^{N} |L_0 - L_i| \times W_i \times D_i \leqq 190 \quad \text{(I)}$$

wherein N is a number of powder coatings to be combined, which is an integer of 2 or more, $L_0$ is lightness of a target color, $L_i$ is lightness of an "i"th powder coating to be combined, $W_i$ is a blending weight ratio of an "i"th powder coating to be combined ($0<W_i<1$), $D_i$ is a volume-average particle size (μm) of an "i"th powder coating to be combined.

2. The method according to claim 1, wherein a powder coating having a volume-average particle size of greater than 15 μm and less than or equal to 50 μm is used in the combination of powder coatings.

3. The method according to claim 1, wherein a powder coating having an achromatic color and a powder coating having a chromatic color are used in the combination of powder coatings.

4. The method according to claim 3, wherein one or two powder coatings having an achromatic color are used in the combination of powder coatings.

5. A method for preparing a coating film comprising applying powder coatings combined by the method of claim 1 to a substrate.

* * * * *